United States Patent [19]

Verheesen

[11] Patent Number: 4,897,163

[45] Date of Patent: Jan. 30, 1990

[54] METAL CYLINDRICAL SCREEN MADE OF SHEET MATERIAL, AND PROCESS FOR PRODUCING SUCH A SCREEN

[75] Inventor: Wilhelmus J. F. Verheesen, Horn, Netherlands

[73] Assignee: Stork X-Cel B.V., Netherlands

[21] Appl. No.: 329,652

[22] Filed: Mar. 28, 1989

[30] Foreign Application Priority Data

Apr. 5, 1988 [NL] Netherlands ..... 8800865

[51] Int. Cl.[4] ..... C25D 1/08

[52] U.S. Cl. ..... 204/11

[58] Field of Search ..... 204/11

[56] References Cited

U.S. PATENT DOCUMENTS 3,044,167 7/1962 Mathieu ..... 29/163.6
3,482,300 12/1969 Reinke ..... 29/160
3,759,799 9/1973 Reinke ..... 204/16

*Primary Examiner*—T. M. Tufariello
*Attorney, Agent, or Firm*—Thomas E. Sisson

[57] ABSTRACT

Disclosed is a cylindrical metal screen which has been manufactured by starting from a sheet of material which has been formed in one or more stages, of which at least the first stage is an electroforming stage.

To form the cylinder the ends of the sheet-form material are connected by spot welding or mechanically by the presence of mating projections and recesses in the ends of the material to be connected.

Also is described a process for forming such a material.

13 Claims, 3 Drawing Sheets

METAL CYLINDRICAL SCREEN MADE OF SHEET MATERIAL, AND PROCESS FOR PRODUCING SUCH A SCREEN

BACKGROUND OF THE INVENTION

The present invention relates in the first place to a metal screen in cylindrical form, comprising a sheet metal screen material, two ends of which are joined together Such a screen is known from U.S. Pat. No. 3,482,300. The above-mentioned patent specification describes the formation of a screen which is based on a woven gauze made of conducting material which is first subjected in the stretched state to an electrode position treatment for depositing a metal layer on the woven gauze, in such a way that the threads crossing each other are joined together by a metal layer. The fabric thus made rigid is then formed into a cylinder, following which the ends of the gauze material touching each other are joined together, for example by soldering.

With such a process it is possible to obtain a metal screen material and, by making the correct choice of the format of the starting material, it is possible to obtain a screen which as regards pattern repeat length and as regards pattern repeat width meets the demands of the user.

Such an option is very important, for example when label material has to be produced by means of silk-screen printing.

During the production of such a material it is desirable to restrict the quantity of waste to the very minimum; in view of the great variety of label sizes required by customers, the availability of a stencil material where the repeat length in particular can be set as desired is extremely important.

The metal cylindrical screens which are obtained according to the above-mentioned U.S. Patent Specification do, however, have the disadvantage that they are relatively thick, which means that the layer of ink applied to a substrate during printing is also relatively thick.

When labels in particular are being produced the cost of the inks used also plays a major role; screen materials making it possible to combine the minimum ink application with good cover, great definition, and the possibility of very fine detailing are therefore very desirable.

SUMMARY OF THE INVENTION

The object of the present invention is to produce a screen material of the above-mentioned type with which it is possible to combine cover, definition and fine detail with the possibility of applying the minimum quantity of ink by printing.

According to the invention, such a screen material is characterized in that the sheet metal screen material used is a screen material formed in one or more stages, at least the first stage of which comprises electrode position of metal on a matrix.

It was in fact found that it is possible to shape an electroformed metal screen material, for example a screen material consisting of nickel, from a sheet material into cylindrical form by forming a connection between the two ends of such a sheet material which have been brought together.

A screen material which is formed in at least one or more stages, at least the first stage of which comprises electro-deposition of metal on a mould, is generally understood to be an electroformed screen material. Such screen materials are generally known and are used in particular in textile and paper printing machines working on the rotary or flat silk screen printing principle.

Such an electroformed screen material is produced by depositioning metal on an electrically conducting matrix whose surface is provided with places of non-conducting material which are arranged in a pattern. The pattern used corresponds to the pattern of apertures subsequently found in the ready screen material. Such a material can be formed in one go on a matrix; such a material can also be produced by first forming a thin skeleton on a matrix and then removing said skeleton from the matrix and making this skeleton the required end thickness in a separate electroforming operation.

Through selection of the electrolysis current used and/or the selected bath composition, the metal deposition on the lands of the skeleton can be given a desired shape.

Such electroformed silk-screen printing materials can be made in any desired thickness; the lands surrounding the perforations in such a material are a uniform maximum height round each perforation.

The materials from U.S. Pat. No. 3,482,300 described earlier, which are formed starting from woven gauze, have a non-uniform dam thickens round the perforations, which has to do with the fact that in the intersection points of the threads the thickness is at least twice the initial thread thickness.

It has now been found that by starting from screen material which is electroformed at least in the first stage it is possible to obtain a cylindrical screen which meets the above-mentioned object of the invention.

In particular, in the screen according to the invention the ends of the material are connected overlapping each other, while at the point of overlap the ready material has an overall thickness between 1.0 and 1.5 times the initial thickness of the sheet screen material, and said thickness in the overlap area preferably lies between 1.0 and 1.25 times the initial thickness of the sheet screen material As will emerge later, it is possible to form the connection between the ends of the initial material while at the same time compressing the material in the overlap area, so that the thickness in the overlap area is less than twice the initial thickness.

The overlap length is kept as small as possible and is advantageously between 0.1 and 0.5 mm, and preferably between 0.1 and 0.2 mm.

The connection between the overlapping parts of the initial screen material is very advantageously a spot welded joint.

The sheet starting material used according to the present invention for forming the screen material is very often a nickel starting material.

Electrodeposited nickel can in certain cases contain extremely small quantities of in built sulphur which make the material sensitive to high temperatures.

It has now been found that by applying a spot welding process using the process to be described below even electro-deposited nickel containing sulphur compounds can be spot welded.

In another attractive embodiment of the screen material according to the invention the ends of the sheet screen material are notched, so that at the parts to be joined together complementary projections and recesses are present in the plane of the material which are joined together by fitting tightly into each other.

Forming projections and recesses adapted to each other in the ends of the material to be joined together makes it possible to anchor the ends to each other mechanically, which gives the material excellent tensile strength in the peripheral direction.

The shape of the projections and recesses can be selected as desired, e.g. a dovetail shape, round shape, T-shape, L-shape, Y-shape and any other shape which permits mechanical loading of the engaging parts.

Although in principle the projections and recesses can be designed in such a way that no further locking is necessary (for example when the projections and recesses are in the form of a sort of zip fastener), an additional connecting medium will still in general be fitted over the connecting point.

In particular, the connecting medium will comprise an adhesive strip of a suitable material, a suitable adhesive being used.

The invention also relates to a process for forming a cylindrical screen, starting from a sheet screen material of suitable dimensions, and joining together two ends of said screen material.

The above process according to the invention is characterized in that the starting material is starting screen material which is formed in one or more stages, and at least the first stage of which involves electrode position of metal on a matrix, said material is worked into the correct shape and dimensions, and the ends of the starting screen material are then connected.

The ends of the starting screen material are in particular connected by spot welding, with the exertion of pressure.

Through the spot welding, in which the two overlapping material parts are forced against each other, following which an electrical current is passed through them, the material becomes warm, and at sufficiently high pressure the material can even be compressed to a considerable degree.

Starting from, for example, material 100 micrometers thick, the overlap thickness can be reduced to a total of approx. 150 micrometers by suitable pressure and the application of a suitable current.

On account of the properties of the starting material, the material will advantageously be cooled during the spot welding operation. Said cooling can take place in such a way that a substantial temperature increase takes place only at the boundary face of the two materials to be joined together, while the mass of the material remains at a relatively low temperature. In particular, such a cooling can prevent the material from becoming brittle, for example when joining nickel material containing sulphur compounds For the formation of a homogeneous welded seam the connecting points can very advantageously be positioned in such a way that they partially overlap in the axial direction of the screen.

In another embodiment of the process for joining the ends of the screen material, starting from the screen material cut to size, projections and recesses lying in the plane of the material, and complementing each other, are formed on the ends to be joined together, following which the ends are connected to each other by fitting the corresponding projections and recesses into each other, thereby forming a connection which can be mechanically loaded.

As indicated earlier, the connection formed will in general be supplemented by a connecting medium which is advantageously made up of an adhesive strip which is fastened with an adhesive to the outside of the screen formed.

BRIEF DESCRIPTION OF THE DRAWINGS

The invention will now be explained with reference to the drawing, in which

In FIG. 1 a screen according to the invention is indicated by 1, the screen being a cylindrical screen with a cylinder axis 2.

Reference number 3 shows schematically that the screen has perforations, while the connecting seam formed is indicated by 4.

The seam 4 is indicated here as being parallel to the cylinder axis. Such parallelism is, of course, not necessary; the seam can essentially be any shape which is desired; the seam can, for example, in certain cases be placed in such a way that it runs between pattern parts to be printed using the screen.

The seam can in any of the cases be formed as desired by spot welding or by the formation of a pattern of projections and recesses by suitable notching of the ends to be joined together.

Figure 1:
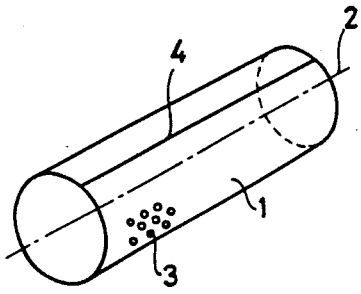
FIG. 1 represents a formed metal cylindrical screen according to the invention.
Figure 2:
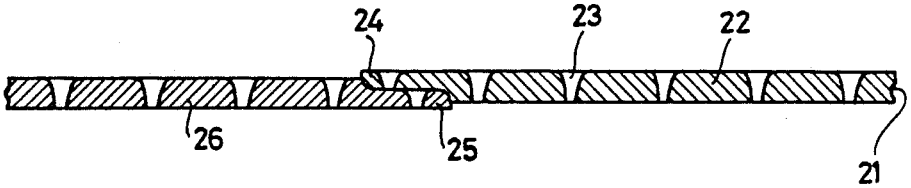
FIG. 2 shows a sectional view of a screen according to the invention at the overlapping parts of the seam.

FIG. 2 shows a screen 21 with lands 22 and 26 and perforations 23. The overlapping parts are indicated by 24 and 25. It can be seen clearly in the figure that compression has taken place, so that the thickness at the point of the overlap is less than twice the initial thickness of the material.

Figure 3:
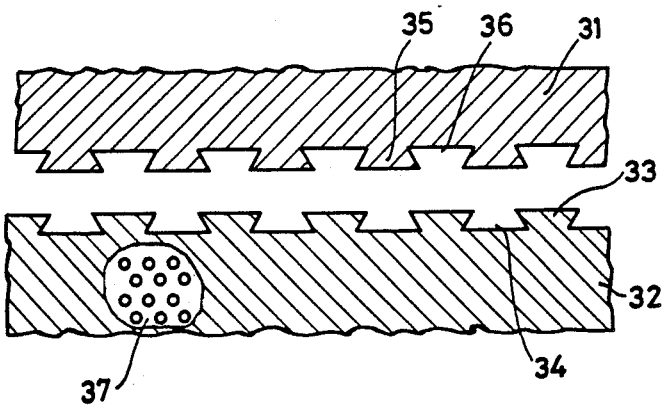
FIG. 3 shows the ends of a sheet screen material which are notched to permit a mechanical connection with each other.

FIG. 3 shows a situation in which a mechanical connecting facility has been created by forming projections and recesses in the ends to be joined together.

As indicated earlier, the projection and recess patterns are formed by appropriate notching of the ends of the material to be joined together.

Said notching can take place in many different ways; one could mention punching, electron beam cutting, laser beam cutting, water jet cutting etc.

The ends are indicated by 31, 32, while the projections and recesses corresponding to each other are indicated by 33 and 36 and 34 and 35 respectively. Reference number 37 indicates schematically that the material is a screen material.

Figure 4:
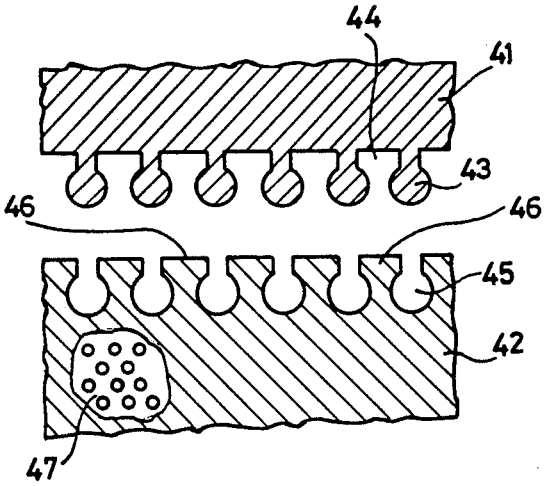
FIG. 4 is a picture as shown in FIG. 3, in which the projections and recesses are a different shape.

FIG. 4 shows that the projections and recesses can also be a different shape from that which is shown in FIG. 3. The mushroom-shaped projection 43 can be accommodated accurately by the recess 45.

Figure 5:
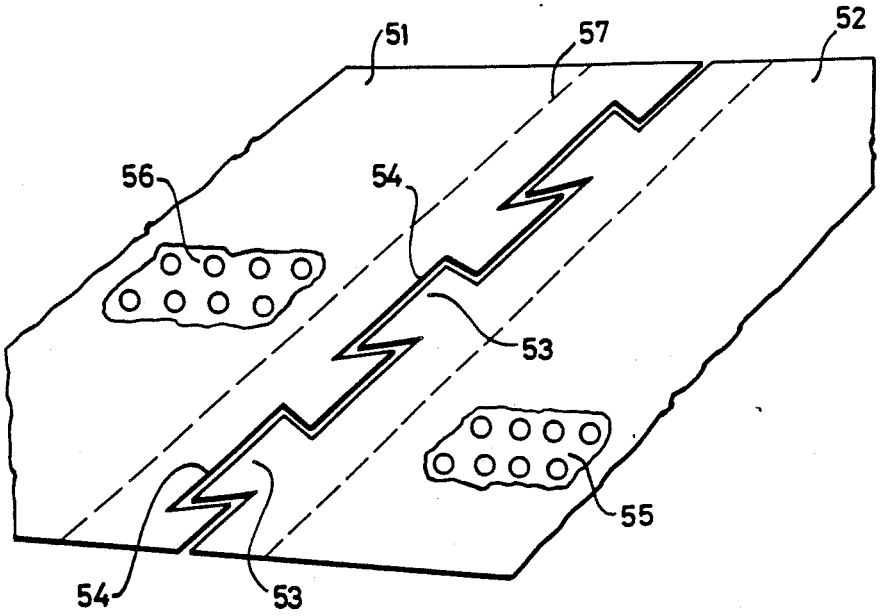
FIG. 5 shows schematically in top view a connection formed in screen according to the invention.

FIG. 5 shows ends 51 and 52 connected to each other through the projections 53 being accommodated in a close fit in the recesses 54.

Reference number 57 shows schematically that an adhesive strip, fixed with an adhesive, is subsequently fitted at that place.

Figure 6:
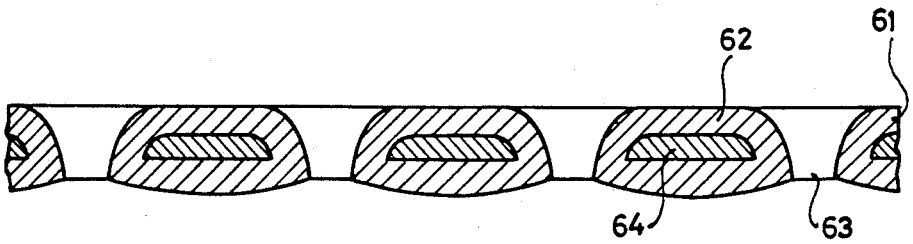
FIG. 6 shows in cross section a screen material which is used for forming a screen according to the invention.

FIG. 6 shows a typical screen material used for forming a screen according to the invention. The screen material is a completely electroformed material, for example of nickel, in a first stage a metal screen skeleton being formed, the lands of which are indicated by 64. Following the formation of the skeleton, said skeleton is removed from the used matrix and brought to its final thickness in a separate bath through the formation of a metal deposit 62, the shape of the deposit 62 additionally applied being largely determined by a suitable choice of processing conditions.

As already indicated, the material shown in FIG. 6 can be entirely of nickel; but material such as copper, tin nickel and iron can also be used.

Although according to the invention the starting material is a screen material which may if desired be formed in several stages, at least the first stage of which is an electro deposition stage, any subsequent stages need not be electrolytic: known techniques such as electroless deposition of metal, plasma jet spraying of metal and chemical vapour deposition of metal can also be used.

What is claimed is:

1. Metal screen in cylindrical form, comprising a sheet metal screen material, two ends of which are joined together, in which said sheet metal screen material used is a screen material formed in one or more stages, at least the first stage of which comprises electrodeposition of metal on a matrix and wherein said ends of said material are connected overlapping each other, and at the point of overlap the ready material has an overall thickness between 1.0 and 1.5 times the initial thickness of said sheet screen material.

2. Screen according to claim 1, in which the thickness in the overlap area lies between 1.0 and 1.25 times the initial thickness of the sheet screen material

3. Screen according to claim 1, in which the overlap length is between 0.1 and 0.5 mm.

4. Screen according to claim 2, in which the overlap length is between 0.1 and 0.2 mm.

5. Screen according to claim 1, in which the connection is a spot welded connection.

6. Metal screen in cylindrical form, comprising a sheet metal screen material, two ends of which are joined together, in which said sheet metal screen material used is a screen material formed in one or more stages, at least the first stage of which comprises electrode position of metal on a matrix and wherein said ends of said sheet screen material are notched, so that on the parts to be joined together complementary projections and recesses are present in the plane of said material, which are tightly joined together by fitting into each other.

7. Screen according to claim 6, in which the shape of said projections and said recesses is selected from the group consisting of a dove-tail shape, round shape, T-shape, L-shape, Y-shape and any other shape which permits a mechanical loading of said mating parts.

8. Screen according to claim 6, in which an additional connecting medium is fitted over said mating projections and recesses.

9. Screen according to claim 8, in which said connecting medium is an adhesive strip made of a suitable material, using a suitable adhesive.

10. Process for forming a cylindrical screen, starting from a sheet screen material of suitable dimensions and joining together two ends of said screen material, in which the starting material is a starting screen material which is formed in one or more stages, and at least the first stage of which involves electrode position of metal on a matrix, said material is applied in the correct shape and dimensions, and said ends of said starting screen material are then connected, with said ends are connected by spot welding, with the exertion of pressure, said material is cooled during spot welding and the connecting points formed by spot welding partially overlap each other in the axial direction

11. Process for forming a cylindrical screen, starting from a sheet screen material of suitable dimensions and joining together two ends of said screen material, in which the starting material is a starting screen material which is formed in one or more stages, and at least the first stage of which involves electrode position of metal on a matrix, said material is applied in the correct shape and dimensions, and said ends of said starting screen material are then connected and wherein, starting from said metal screen material cut to size, projections and recesses, lying in the plane of said material and complementing each other, are formed on said ends to be joined together, following which said ends are connected to each other by fitting the corresponding projections and recesses into each other, thereby forming a connection which can be loaded mechanically.

12. Process according to claim 11, in which the connection formed is supplemented by a connecting medium which is fitted over the mating projections and recesses.

13. Process according to claim 12, in which the connecting medium is an adhesive strip which is fixed with an adhesive.

* * * * *